United States Patent [19]

Arentzen

[11] 3,968,995

[45] July 13, 1976

[54] CONTINUOUS MINING MACHINE WITH A CHAIN DRIVE FOR THE CUTTING HEAD

[75] Inventor: Einar M. Arentzen, Charleroi, Pa.

[73] Assignee: Dresser Industries, Inc., Dallas, Tex.

[22] Filed: Jan. 8, 1974

[21] Appl. No.: 431,625

[52] U.S. Cl. ..... 299/76; 37/191 A; 74/243 R; 74/250 R; 175/89; 299/83; 299/84

[51] Int. Cl.[2] ..... E21C 25/52; E21C 25/36

[58] Field of Search ..... 299/82, 83, 84, 75, 299/76, 64; 37/191 A, 191 R, 86 R, 86 A; 30/281, 283; 74/250 R, 243 R

[56] References Cited

UNITED STATES PATENTS

| | | | |
|---|---|---|---|
| 2,155,584 | 4/1939 | Bryant et al. | 74/250 R |
| 2,344,750 | 3/1944 | Stoltz | 299/82 |
| 2,569,584 | 10/1951 | Shepherd-Smith | 299/84 |
| 2,581,723 | 1/1952 | Simmons | 299/82 |
| 2,704,407 | 3/1955 | Talboys | 37/191 R |
| 2,810,568 | 10/1957 | Fritzche | 299/82 |
| 2,865,621 | 12/1958 | Proctor | 299/82 |
| 3,062,518 | 11/1962 | Osgood | 299/75 X |
| 3,479,090 | 11/1969 | McCracken | 299/76 X |

FOREIGN PATENTS OR APPLICATIONS

| | | | |
|---|---|---|---|
| 830,700 | 3/1960 | United Kingdom | 74/250 R |
| 849,289 | 9/1960 | United Kingdom | 299/84 |

*Primary Examiner*—Frank L. Abbott
*Assistant Examiner*—William F. Pate, III
*Attorney, Agent, or Firm*—John M. Lorenzen; John N. Hazelwood

[57] ABSTRACT

A drive chain for transmitting power to a rotatable cutter head of a mining machine. The mining machine is of the type having a rotary cutter drum mounted at the forward end of the mining machine frame. The cutter drum has helical auger flights with cutter bits mounted on their periphery. Electric motors are provided on either side of the mining machine to provide power for rotating the cutter drum. A drive and cutter chain transmits the power from each electric motor to the rotary drum. The drive chain comprises roller chain links with offset sidebars. Each drive chain is relatively narrow having but a single row of links. Some of the links are cutter links which carry cutter bits. Selected portions of the cutter links and the sprockets are cut away to prevent entrapment and build up of foreign matter.

2 Claims, 5 Drawing Figures

CONTINUOUS MINING MACHINE WITH A CHAIN DRIVE FOR THE CUTTING HEAD

BACKGROUND OF THE INVENTION

The present invention relates to mining machines, and more particularly to a drive structure for rotating a non-oscillating mining head that is disposed transverse to the forward motion of the mining machine.

A typical continuous mining machine has a mining head at the front end for cutting and breaking the material from the mine face. A gathering head is usually disposed below the mining head to collect the mined material and feed it to a conveyor which conveys it to the rear of the mining machine. From the rear of the machine the mined material is discharged to a haulage vehicle or other equipment which takes the material away from the place of the mining operation. The mining head is typically driven by electric motors connected to the head by appropriate drive gears. A cutting or trim chain has typically been used to cut a path for the gear case and support arms which connect the mining head to the forward end of the mining machine.

The cutting chain or trim chain used on present day mining machines has evolved from the cutting chain originally used on cutter bars for conventional mining operations. The original cutter chains were mounted on a cutter bar that extended forwardly from the machine. And the cutter chain extended around the perimeter of the bar forming an orbital path. The cutter chain and bar were used to cut a narrow slot in the coal face as a preliminary step before drilling and shooting the coal.

Many inventions have been directed at designing cutter bits to withstand the force of cutting. Other inventions have had as their principal object the avoidance of entrapment or build up of coal dust between the sprocket teeth and the chain elements. Such build up causes the chain to ride around its sprocket at a diameter greater than the pitch diameter, thus producing excessive tensional forces on the chain.

The chains used on the present continuous non-oscillating drum type mining machines have encountered similar problems. Although the power to the cutter head is supplied by electric motors through appropriate gear transmissions, and although the chains have been used primarily to cut a path for the gear case, the chains have suffered the same problems of dust and dirt build up. U.S. Pat. No. 3,305,273 discloses one such attempt to avoid the dirt build up. In that patent the sprockets work against the outer ends of the chain pins. The pins fit between teeth, but one side is open so that the dirt or dust has a better chance to get away from the chain. In subsequent mining machine designs the trim chain has been eliminated altogether by extending the outer casing of the cutter drum over the centrally located gear case. However, extending the cutter drum casing in a cantilever method over the gear case has created other problems. The rotary drum is now more difficult to repair and maintain because it is now more difficult to remove it.

SUMMARY OF THE INVENTION

Accordingly, it is the object of the present invention to provide an improved means for transmitting power to drive a mining head.

Another object of the present invention resides in the provision of an improved drive chain for transmitting power from an electric motor to a mining head.

A further object of the present invention is to provide a drive chain for a mining machine which is not prone to collecting dirt.

Another object of the invention is to provide a drive chain which permits the use of drive sprockets having a full complement of teeth.

Still another object of the invention is to provide means that allow for easy replacement of the mining head to aid maintenance and repair.

These and other objects of the present invention are obtained by providing a continuous miner having a front cutter head frame with a rotary cutting head rotatably mounted at its forward end. The axis of the cutting head is disposed parallel to the face of the mine. The power for rotating the cutting head is provided by a pair of electric motors. The power is transmitted from the electric motors to the cutting head by drive chains having roller chain links and offset sidebars. Each drive chain is relatively narrow, having only enough width to support one or two cutter bits. To reduce dirt build up between the chain and the sprocket, dirt relief gashes are cut into the sprocket. In addition, each cutter link of the chain is structured to reduce entrapment of dirt between the sprockets and the chains. Circular milled cuts are formed in both the forward and rearward portions of the cutter links to provide openings through which the dirt may escape.

Although the overall width of each chain is less than six inches, the roller chain has the operating and strength characteristics to drive a mining head. The chain rollers provide rolling action as the chain enters and leaves the sprockets to reduce friction and promote smoother action of the chain. The bit support blocks are attached to the top of the chain links and selected portions of the blocks are cut away to provide chain that can be driven by a sprocket having a full complement of teeth.

The chain drive of the present invention provides a simpler, less costly and more practical arrangement than gear drives because the center-to-center shaft distance is much less restrictive for the chain drive than for gear drives. In addition, the chain drive of this invention is more easily installed than gears. All drive media require careful alignment and installation, but the machinery built for a chain drive need not be held to as close a tolerance as that required for a gear drive. Typically, the chain is less costly to install. In addition, later changes in requirements are more easily accomplished with a chain drive than with gears due to the flexibility of a chain installation. These advantages of a chain drive are amplified in a mining situation where the environment for maintenance or repair is often less than ideal. Another advantage of the present chain drive is that it is less sensitive to foreign materials and will operate well in rugged environments.

DESCRIPTION OF THE PREFERRED EMBODIMENT

Figure 2:
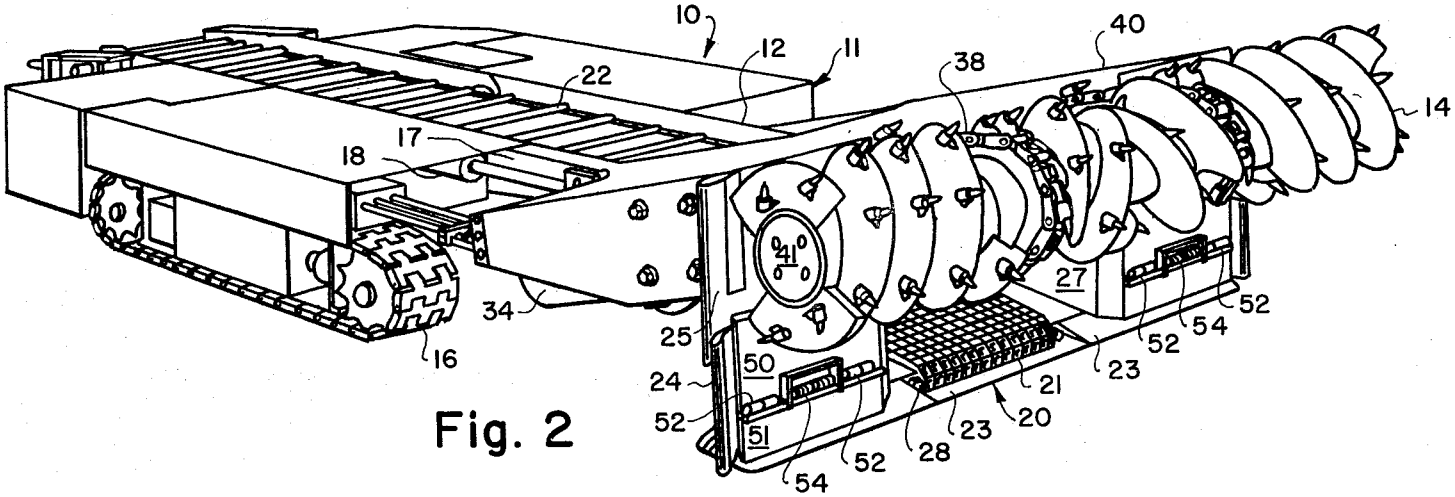
FIG. 2 is another perspective view of the mining machine shown in FIG. 1 with the mining head in the raised position.
Figure 1:
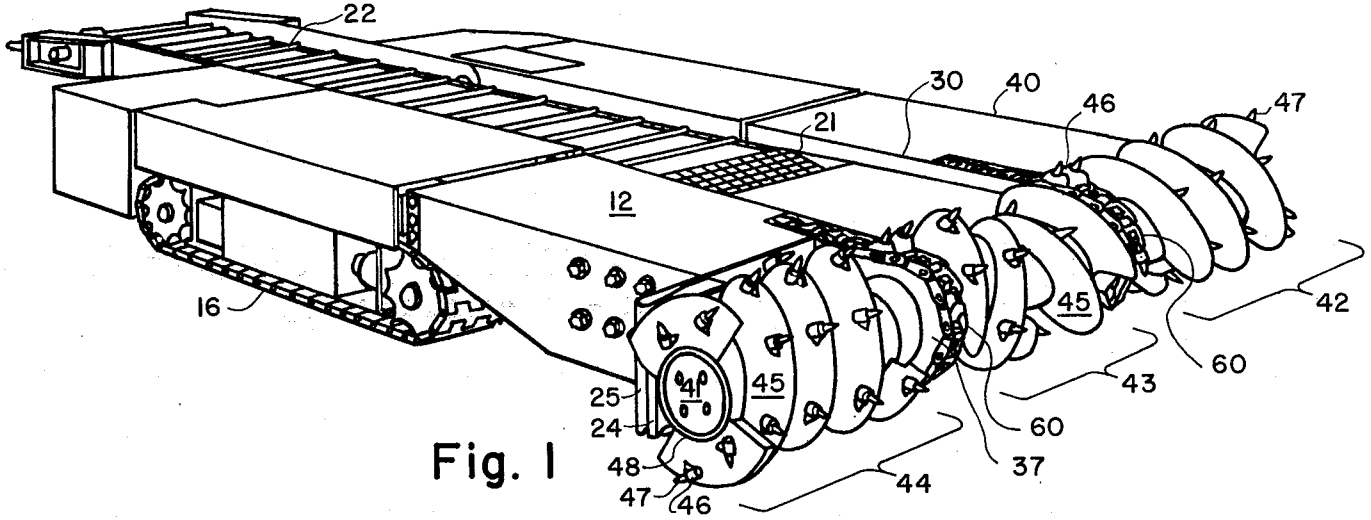
FIG. 1 is a perspective view of a mining machine incorporating the drive means of the present invention.

A continuous mining machine 10 shown in FIGS. 1 and 2 of the drawings has a mining head 14 with a rotary drum 40 for cutting and breaking material from a mine face. Endless crawler tractor treads 16, disposed one on each side of the main frame, propel the machine. A second frame or sump frame 12 is mounted on top of the main frame 11. The sump frame 12 is connected to the main frame 11 by means of a tongue 17 and groove (not shown) arrangement, thus enabling the sump frame to be moved horizontally away from the main frame. The sump frame 12 is moved forward and backward hydraulic a pair of hydraulic cylinders 18 located on opposite sides of the machine, one of which is illustrated. Each hyduralic cylinder 18 is connected at one end to the main frame 11 and at the other end to the sump frame 12. By activating the hydraulic cylinders, the rotary drum 40 is advanced or sumped into the mine face.

Because the chassis of the mining machine is configured with a central sliding sump frame, it permits the crawlers 16 to remain locked while advancing or sumping the rotary drum or augers 40 into a mine face. This design takes advantage of the fact that the static coefficient of friction between the fixed crawlers and the floor is approximately 50% greater than the dynamic coefficient of friction between moving crawlers and the floor. The hydraulic cylinders 18 act to move the sliding sump frame 12 forward. The sliding sump frame 12 carries the auger head 40, gathering head 20 and conveyor assemblies 21 and 22 in its forward and rearward movement.

The mining head 14 has two parallel support arms 30 that extend forwardly to support the rotary drum 40 at the front end of the sump frame 12 of the mining machine 10. The arms 30 are connected by a pivot structure (not shown) to the sump frame. A backup panel or cross member 25 is disposed at the forward end of the arms 30 just rearward of and parallel to the rotary drum 40.

The mining head 14 is pivotally mounted by the pivot structure and is moved upwardly and downwardly by a pair of hydraulic cylinders (not shown) located on opposite sides of the sump frame 12. Each of these hydraulic cylinders is pivotally connected at one end to the sump frame 12 and at the other end to the arms 30.

The rotary drum 40 is driven by a pair of electric motors 34, one of which is shown in FIG. 2, that are disposed at opposite sides of the sump frame 12. The motors 34 drive motor gear transmissions and a clutch mechanism (not shown). Each of the clutches is connected by means of a drive sprocket to a drive chain 60 that delivers drive by means of a second sprocket 37 to the rotary drum.

The forward sprocket wheel is fixed to a shaft 41 which extends transversely to the arms 30. Fixed to the shaft are three auger cutting sections 42, 43 and 44. Each auger section comprises a pair of helical blades 45 having their inner peripheries fixed securely to the adjacent portion of the casing 48 of the shaft 41 and the outer peripheries of a substantial constant radial extent. The pitch of the blades 45 of each section is such that when rotated they will serve to convey the material inwardly toward the forward end of the centrally disposed conveyor 21.

The outer periphery of each helical blade 45 of each auger section 42, 43, 44 has secured thereto a plurality of spaced bit holders 46 arranged to receive bits 47 of conventional structure that extend outwardly from the periphery of the blade 45. The bits on each blade are spaced apart equally in a longitudinal or axial direction.

There is a gathering head structure 20 at the front of the mining machine structure 10 below the arms 30. The gathering head 20 is pivotally mounted on a pivot point (not shown) separate from the mining head pivot. The gathering head structure 20 has an apron or front deck 23 with its leading edge at the floor. The gathering head structure carries a vertical dozer blade 24 on each side of a center conveyor throat 27 and provides a deck upon which a gathering chain 21 may operate. A small diameter roller foot shaft 28 is positioned very close to the front of the gathering head 20 to provide a rotatable structure which the gathering chain 21 may rotate on its return to the rear of the gathering head 20.

The upper portion 50 of the vertical dozer blade 24 is hinged at hinge points 52 to the lower portion 51 of the blade 24. Four torsional springs 54 spring-load the upper portion 50 of the blade and force it rearwardly towards the backup panel 25 of the mining head 14, which is located immediately behind the rotating drum 40. As the rotary drum 40 is raised or lowered relative to the gathering head 20, the upper edge of the hinged dozer blade 24 remains in contact with the mining head backup panel 25.

The loading of cut mined material is achieved by the helical auger flights 42, 44 working in conjunction with the backup panel 25 and dozer blades 24 on one side and the mine floor and mine face on the other sides. The backup panel 25, the dozer blades 24, the mine floor and the mine face combine to form three exterior walls of a screw conveyor. The three walls contain the mined material within the outer helical auger flights 42, 44 so that the material may be moved to the center conveyor throat 27 of the machine 10. At this center point, the combination of the return position of the drive chains 60 and the center auger section 43 pushes the mined material back and onto the gathering chain 21. The gathering chain 21 moves the material rearwardly to a second conveyor 22 that moves the mined material to other conveying means (not shown) which remove the material from the mine.

Figure 3:
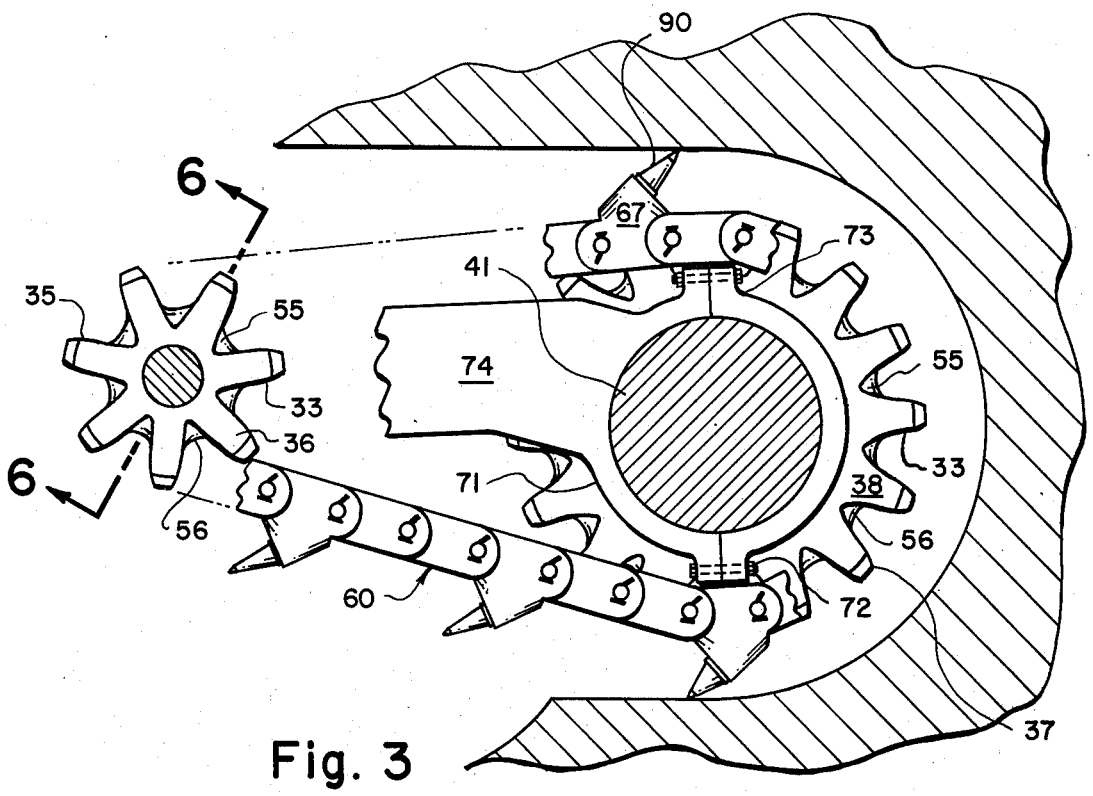
FIG. 3 is an enlarged sectional view of the mining head illustrating the sprockets and drive chain of the present invention.

FIG. 3 illustrates in greater detail the drive chain connection between the motors 34 and the mining head 14. Both the rear drive sprocket 35 and the front driven sprocket 37 have conventional drive chain teeth forms 36 and 38 with the point of each tooth machined off to provide clearance between the under portion of the bit block links 67, 68 and the teeth 36, 38. The working face 33 of the sprocket teeth may be of any shape as long as the correct pressure angle is approximately maintained. The face 33 must be of sufficient length to accept the desired amount of chain elongation. But it must not be so long that it interferes with the rollers as the chain flexes into or out of the pockets 55 formed between the teeth.

Figure 4:
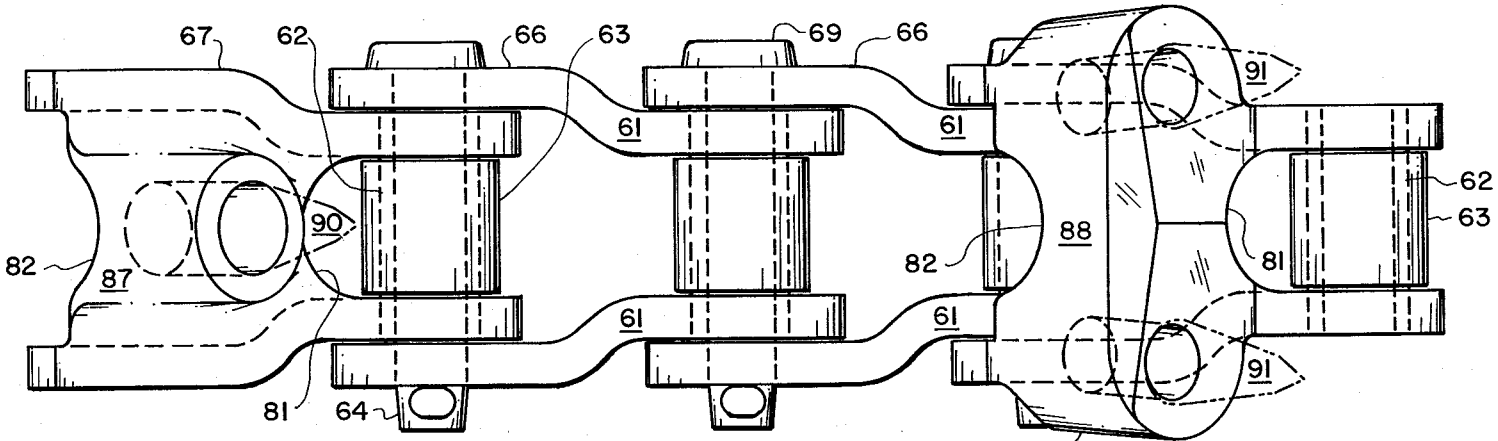
FIG. 4 is an enlarged plan view of the drive chain.
Figure 5:
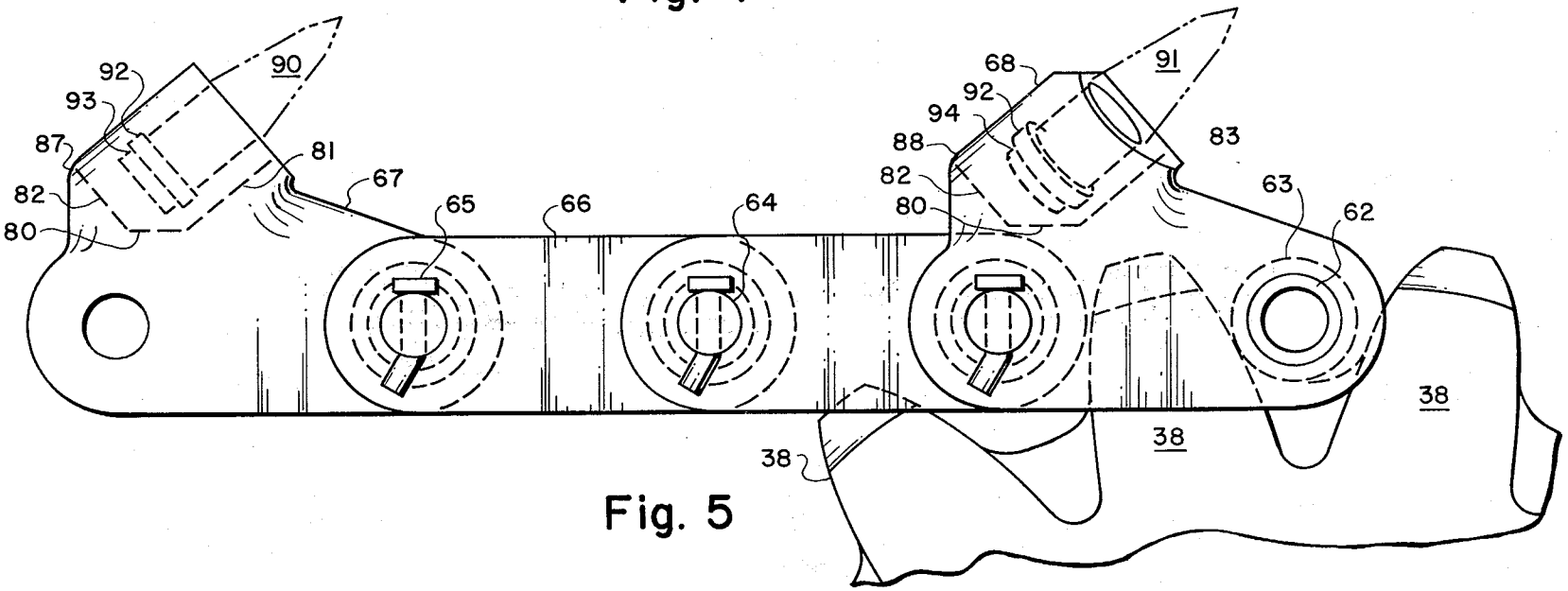
FIG. 5 is a side elevational view of the drive chain shown in FIG. 4.

The details of the drive chain are illustrated in FIGS. 4 and 5. The links are of the offset sidebar type. The links consist of pins 64, bushings 62, offset sidebars 61 and rollers 63. The pins 64 and bushings or thimbles 62 provide the bearing surfaces for the chain 60 to articulate over the sprockets. The pin-bushing bearing area is typically referred to as the "chain joint." The sidebars 61 connect these bearing surfaces and form a chain. The sidebars also establish the chain pitch which is the distance between chain joints. The rollers provide smooth rolling action during engagement with the sprocket teeth.

The chain pins 64 form one part of the chain joint. In addition, each pin connects one link to another and is the shear member between each set of inner and outer sidebars. Each pin 64 is locked laterally in the sidebars 61 by a pin head 69 on one end and by a fastener 65 on the opposite end. In order to prevent rapid chain elongation, the articulation must take place between the pin 64 and bushing 62. Accordingly, the pin 64 must be prevented from rotating in the outer sidebars 61. This is accomplished by press fits between the pin and sidebars.

The chain bushings 62 form the other part of each chain joint. The bushings 62 are locked laterally by use of press fits and are prevented from rotating in the sidebars 61 by press fits between the bushing and sidebars. The bushing outside diameter also provides a bearing surface for the roller 63. The chain sidebars 61 are the tensile members connecting the chain joints. As indicated earlier, the chain sidebars also establish the pitch of the chain. The chain rollers 63 provide rolling action as the chain enters and leaves the sprockets 35, 37. This roller action reduces friction and promotes smoother action of the chain.

Each sprocket 35, 37 is provided with the full complement of sprocket teeth so the ability of each sprocket to transmit torque is improved. In the embodiment shown, the rear sprocket 35 has seven teeth and the front sprocket 37 has fourteen. Generally, each tooth in contact on a sprocket should share the load. Therefore, prior mining machine block and bar chain sprockets such as disclosed in U.S. Pat. No. 3,679,265 which have few teeth require each tooth to carry a greater portion of the total force. Whereas, in the present invention each sprocket tooth carries a lesser portion of the total applied force because of the greater number of teeth.

The roller drive chain 60 is especially advantageous for use on a mining machine because when the chain 60 and sprockets 35, 37 are interacting properly the working face 33 is the only functioning surface of the sprocket tooth. The roller 63 rides up on the tooth as pressure is applied and seeks its own pitch diameter. The force is transmitted through contact between the chain roller 63 and the working face 33 of the tooth. The roller does not contact the bottom diameter surface 56 except at the balance point. Since the bottom diameter surface 56 carries little load, the flat portion in the pocket 55 between the teeth can be nearly eliminated. Dirt gashes or reliefs 57 can be cut on either side of the pockets 55 between the sprocket teeth 36, 38 to promote discharge of dirt from between the rollers and sprocket teeth.

Figure 6:
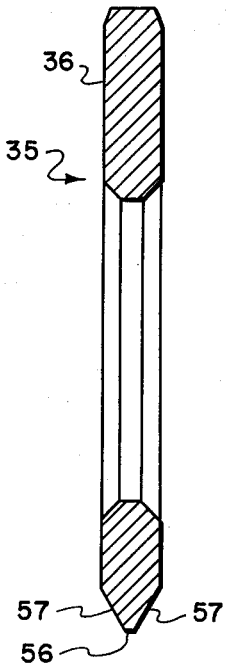
FIG. 6 is an enlarged sectional view taken substantially along line 6—6 of FIG. 3 showing the dirt relief gashes cut between the sprocket teeth.

The cross-sectional view of FIG. 6 illustrates the relief that is cut between each pair of sprocket teeth. The sides of the sprocket wheel are milled away to leave a narrow surface about ¼ inch wide at the bottom diameter surface 56. The idea is to present as small of a flat surface 56 as is possible so that there is no surface upon which the dirt or coal dust may accumulate. The reliefs accomplish this purpose because as the chain is driven the rollers approach a narrow edge and squeeze and push the foreign particles out away from the chain. In this way the chain is self cleaning.

The use of roller drive chain keeps wear on the sprockets to a minimum. Since the bushings 62 turn, there is no sliding contact on the tooth face as there would be with rigid knuckle chain. The load is principally applied between the inside surface of the roller 63 and the outside surface of the bushing 62. This is in contrast to the line contact point which exists on non-roller type chain.

Heretofore the prior art has directed much of its attention to designing special cutter bits to withstand the force of cutting. Typically, this force acts on the bit to try to tip it rearwardly. These cutting forces do not seem to adversely affect the chain of the present invention. The cutter bits are supported on the front driven sprocket 37 when they engage the mine face so the cutting force is not able to bend the cutting bit back.

Each drive chain 60 consists of only three different types of links connected in a single row. The links include the regular connector links 66 and the two different cutter links 67 and 68. The regular cutter links 66 connecting the cutter links 67 and 68 may be conventional roller chain links. Roller chains manufactured by the Jeffrey Manufacturing Company under the designation JS1245A have been found sufficient for the purposes of this invention. The average ultimate strength of such chains is about 170,000 pounds. Larger mining machines such as described in U.S. Pat. No. 3,305,273 may also benefit from the chain drive of the present invention. For these larger machines it may be desirable to increase the chain size to a five or six inch pitch; this would give an average ultimate strength of 300,000 pounds and 420,000 pounds respectively.

Each cutter link 67 carries a single bit 90 positioned exactly on the center line of the chain 60. The second cutter links 68 carry two cutter bits 91, one is mounted on each side of the chain center line; each bit 91 is directed slightly outwardly from the chain center line so that when the double bit links 68 work in conjuncture with the single bit links 67 a bit spacing of about two inches is maintained.

Both the single bit link 67 and the double bit link 68 are made from castings and are provided with conventional pins, bushings and rollers as previously described. Although the cutter links are made from castings, they also could be manufactured by welding bit support blocks to the upper surfaces of conventional offset links.

Each cutter link has been structured to reduce entrapment of foreign matter between the sprockets and the chains. The flat surface on the bottom of the bit support blocks has been reduced to the surface 80. A circular cut-away portion 81, 82 is provided on both the forward and rearward portions of the cutter support blocks 87, 88 to provide openings through which the dirt or other foreign material may escape. In addition, during engagement of the sprocket teeth 36 or 38 with the cutter links 67 or 68, each tooth is offset from the flat surface 80. Thus, there is only a small overlap between the teeth and the cutter support blocks 87, 88. With such a small constricting surface above the top of each tooth, there is very little area for build up of compactible materials.

The cutter bits 90, 91 are of the type conventionally used on mining machines. The bits 90, 91 have a conical shape and are held in place by a collar 92 which expands into the greater diameter spaces 93 or 94 provided in each cutter link support block 87 and 88 respectively.

The rotatable shaft 41 supports the cutting and breaking means of the mining machine. A split collar 71 is secured to the shaft 41 at either side of the longitudinal center line of the mining machine. The inside half 74 of the collar 71 is simply an extension of the support arms 30. The other half is a cap 73 which is secured to the inside half 74 by appropriate fasteners 72. Each split collar 71 is lined with an appropriate bearing (not shown). The rotatable shaft 41 is supported on these bearings. This use of the chain drive makes the present auger head much easier to maintain. To remove the auger head, the chain is removed, the fasteners 72 are released so that the cap 73 may be taken off allowing the complete rotary drum 40 to roll out.

The drive chain used in this invention could possibly be replaced with conventional straight link roller drive chain. However, the offset chain is particularly well adapted to this mining application. The shape of the offset links make it particularly easy to build holders or bosses for the cutter bits. Also, each link in the chain is identical in that any one particular link can be replaced by any other link. The mine operator has to stock only three types of chain links. One is the conventional connecting link, the second is the single bit holder link and the third is the two bit holder link. The offset chain also has the advantage of uniform wear. On straight link roller chain, one end may wear more than another because of the particular use and characteristics of the straight link chain.

Having thus described the invention, those skilled in the art will recognize various uses for and changes in the details and arrangement of parts without departing from the scope of the invention as is defined in the appended claims. It is therefore respectfully requested that the invention be interpreted as broadly as possible according to the provisions of the Patent Statutes and limited only by the scope of the appended claims.

I claim:

1. In a continuous mining machine having a frame mounted for movement toward a mine face, a mining head supported forward of the frame and supporting a rotatable cutter drum on an axis extending transverse to the direction of movement of the frame, rotary power means mounted on the frame, a drive sprocket connected to the power means, a driven sprocket connected to the cutter drum, and a cutter chain connecting said sprockets to transmit power from the power means to the cutter drum, the improvement wherein the chain comprises a succession of articulately connected roller chain links having a pair of spaced side bars connected to adjacent links by a pin and a roller rotatably mounted about said pin between the pair of side bars, wherein some of said links include bit support blocks which extend outwardly from said links opposite the sprocket engaging side of said links with sufficient space between the support block and adjacent rollers and under said support block to allow the teeth of the sprockets to fully engage the roller of said link and further having openings between the support and the rollers effective to allow trapped foreign material such as dirt or coal to escape therebetween as the sprocket teeth squeeze the material against the rollers and support blocks to lessen the build up of foreign matter between the sprockets and the chain; and cutter bits mounted in said support blocks to cut clearance in the mine face for said chains and sprockets.

2. A mining machine as recited in claim 1 wherein the openings are provided by reliefs cut in the bit support blocks.

* * * * *

UNITED STATES PATENT AND TRADEMARK OFFICE

CERTIFICATE OF CORRECTION

PATENT NO. : 3,968,995

DATED : July 13, 1976

INVENTOR(S) : Einar M. Arentzen

It is certified that error appears in the above-identified patent and that said Letters Patent are hereby corrected as shown below:

In the claims, column 8, line 16: after "links" --each-- should be inserted.

In the claims, column 8, line 26: after "support" --block-- should be inserted.

Signed and Sealed this

Fourteenth Day of September 1976

[SEAL]

*Attest:*

RUTH C. MASON
*Attesting Officer*

C. MARSHALL DANN
*Commissioner of Patents and Trademarks*